US007163380B2

(12) United States Patent
Jones

(10) Patent No.: US 7,163,380 B2
(45) Date of Patent: Jan. 16, 2007

(54) CONTROL OF FLUID FLOW IN THE PROCESSING OF AN OBJECT WITH A FLUID

(75) Inventor: William Dale Jones, Phoenix, AZ (US)

(73) Assignee: Tokyo Electron Limited, Tokyo (JP)

( * ) Notice: Subject to any disclaimer, the term of this patent is extended or adjusted under 35 U.S.C. 154(b) by 369 days.

(21) Appl. No.: 10/630,649

(22) Filed: Jul. 29, 2003

(65) Prior Publication Data

US 2005/0025628 A1 Feb. 3, 2005

(51) Int. Cl.
*F04B 49/06* (2006.01)

(52) U.S. Cl. ..... 417/44.1; 417/44.11

(58) Field of Classification Search ..... 417/44.1, 417/44.11, 53

See application file for complete search history.

(56) References Cited

U.S. PATENT DOCUMENTS

| | | | | |
|---|---|---|---|---|
| 2,439,689 | A | 4/1948 | Hyde et al. | |
| 2,617,719 | A | 11/1952 | Stewart | |
| 2,625,886 | A | 1/1953 | Browne | |
| 2,873,597 | A | 2/1959 | Fahringer | |
| 2,993,449 | A | 7/1961 | Harland | 103/87 |
| 3,135,211 | A | 6/1964 | Pezzillo | 103/87 |
| 3,521,765 | A | 7/1970 | Kauffman et al. | |
| 3,623,627 | A | 11/1971 | Bolton | |
| 3,642,020 | A | 2/1972 | Payne | |
| 3,689,025 | A | 9/1972 | Kiser | |
| 3,744,660 | A | 7/1973 | Gaines et al. | |
| 3,890,176 | A | 6/1975 | Bolon | |
| 3,900,551 | A | 8/1975 | Bardoncelli et al. | |
| 3,968,885 | A | 7/1976 | Hassan et al. | |
| 4,029,517 | A | 6/1977 | Rand | |

(Continued)

FOREIGN PATENT DOCUMENTS

| | | |
|---|---|---|
| CH | SE 251213 | 8/1948 |

(Continued)

OTHER PUBLICATIONS

J.B. Rubin et al. "A Comparison of Chilled DI Water/Ozone and Co2-Based Supercritical Fluids as Replacements for Photoresist-Stripping Solvents", IEEE/CPMT Int'l Electronics Manufacturing Technology Symposium, 1998, pp. 308-314.

(Continued)

*Primary Examiner*—William H. Rodriguez
(74) *Attorney, Agent, or Firm*—Haverstock & Owens LLP

(57) ABSTRACT

An apparatus for and methods of control of a fluid flow. In a system for supercritical processing of an object, the apparatus includes a measuring device for measuring a pump performance parameter and a controller for adjusting a fluid flow in response to the performance parameter. The system further includes a processing chamber for performing a supercritical process and a device for circulating at least one of a gaseous, liquid, supercritical and near-supercritical fluid within the processing chamber. A method of control of a fluid flow includes the steps of: measuring a pump performance parameter; comparing a measured pump performance parameter to a predetermined target pump performance parameter; and adjusting a fluid flow in response to a difference in the measured pump performance parameter and the predetermined target pump performance parameter.

6 Claims, 6 Drawing Sheets

U.S. PATENT DOCUMENTS

| | | | | |
|---|---|---|---|---|
| 4,091,643 | A | | 5/1978 | Zucchini |
| 4,145,161 | A | * | 3/1979 | Skinner ..... 417/22 |
| 4,219,333 | A | | 8/1980 | Harris |
| 4,245,154 | A | | 1/1981 | Uehara et al. |
| 4,341,592 | A | | 7/1982 | Shortes et al. |
| 4,349,415 | A | | 9/1982 | DeFilippi et al. |
| 4,355,937 | A | | 10/1982 | Mack et al. |
| 4,367,140 | A | | 1/1983 | Wilson |
| 4,391,511 | A | | 7/1983 | Akiyama et al. |
| 4,406,596 | A | | 9/1983 | Budde |
| 4,422,651 | A | | 12/1983 | Platts |
| 4,426,358 | A | | 1/1984 | Johansson |
| 4,474,199 | A | | 10/1984 | Blaudszun |
| 4,475,993 | A | | 10/1984 | Blander et al. |
| 4,522,788 | A | | 6/1985 | Sitek et al. |
| 4,549,467 | A | | 10/1985 | Wilden et al. |
| 4,574,184 | A | | 3/1986 | Wolf et al. |
| 4,592,306 | A | | 6/1986 | Gallego |
| 4,601,181 | A | | 7/1986 | Privat |
| 4,626,509 | A | | 12/1986 | Lyman |
| 4,670,126 | A | | 6/1987 | Messer et al. |
| 4,682,937 | A | | 7/1987 | Credle, Jr. |
| 4,693,777 | A | | 9/1987 | Hazano et al. |
| 4,749,440 | A | | 6/1988 | Blackwood et al. |
| 4,778,356 | A | | 10/1988 | Hicks |
| 4,788,043 | A | | 11/1988 | Kagiyama et al. |
| 4,789,077 | A | | 12/1988 | Noe |
| 4,823,976 | A | | 4/1989 | White, III et al. |
| 4,825,808 | A | | 5/1989 | Takahashi et al. |
| 4,827,867 | A | | 5/1989 | Takei et al. |
| 4,838,476 | A | | 6/1989 | Rahn |
| 4,865,061 | A | | 9/1989 | Fowler et al. |
| 4,877,530 | A | | 10/1989 | Moses |
| 4,879,004 | A | | 11/1989 | Oesch et al. |
| 4,879,431 | A | | 11/1989 | Bertoncini |
| 4,917,556 | A | | 4/1990 | Stark et al. |
| 4,923,828 | A | | 5/1990 | Gluck et al. |
| 4,924,892 | A | | 5/1990 | Kiba et al. |
| 4,925,790 | A | | 5/1990 | Blanch et al. |
| 4,933,404 | A | | 6/1990 | Beckman et al. |
| 4,944,837 | A | | 7/1990 | Nishikawa et al. |
| 4,951,601 | A | | 8/1990 | Maydan et al. |
| 4,960,140 | A | | 10/1990 | Ishijima et al. |
| 4,983,223 | A | | 1/1991 | Gessner |
| 5,011,542 | A | | 4/1991 | Weil |
| 5,013,366 | A | | 5/1991 | Jackson et al. |
| 5,044,871 | A | | 9/1991 | Davis et al. |
| 5,062,770 | A | | 11/1991 | Story et al. |
| 5,068,040 | A | | 11/1991 | Jackson |
| 5,071,485 | A | | 12/1991 | Matthews et al. |
| 5,091,207 | A | | 2/1992 | Tanaka |
| 5,105,556 | A | | 4/1992 | Kurokawa et al. |
| 5,143,103 | A | | 9/1992 | Basso et al. |
| 5,158,704 | A | | 10/1992 | Fulton et al. |
| 5,167,716 | A | | 12/1992 | Boitnott et al. |
| 5,169,296 | A | | 12/1992 | Wilden |
| 5,169,408 | A | | 12/1992 | Biggerstaff et al. |
| 5,174,917 | A | | 12/1992 | Monzyk |
| 5,185,058 | A | | 2/1993 | Cathey, Jr. |
| 5,185,296 | A | | 2/1993 | Morita et al. |
| 5,186,594 | A | | 2/1993 | Toshima et al. |
| 5,186,718 | A | | 2/1993 | Tepman et al. |
| 5,188,515 | A | | 2/1993 | Horn |
| 5,190,373 | A | | 3/1993 | Dickson et al. |
| 5,191,993 | A | | 3/1993 | Wanger et al. |
| 5,193,560 | A | | 3/1993 | Tanaka et al. |
| 5,195,878 | A | | 3/1993 | Sahiavo et al. |
| 5,196,134 | A | | 3/1993 | Jackson |
| 5,201,960 | A | | 4/1993 | Starov |
| 5,213,485 | A | | 5/1993 | Wilden |
| 5,213,619 | A | | 5/1993 | Jackson et al. |
| 5,215,592 | A | | 6/1993 | Jackson |
| 5,217,043 | A | | 6/1993 | Novakovi |
| 5,221,019 | A | | 6/1993 | Pechacek |
| 5,222,876 | A | | 6/1993 | Budde |
| 5,224,504 | A | | 7/1993 | Thompson et al. |
| 5,225,173 | A | | 7/1993 | Wai |
| 5,236,602 | A | | 8/1993 | Jackson |
| 5,236,669 | A | | 8/1993 | Simmons et al. |
| 5,237,824 | A | | 8/1993 | Pawliszyn |
| 5,238,671 | A | | 8/1993 | Matson et al. |
| 5,240,390 | A | | 8/1993 | Kvinge et al. |
| 5,242,641 | A | | 9/1993 | Horner et al. ..... 264/104 |
| 5,243,821 | A | | 9/1993 | Schuck et al. |
| 5,246,500 | A | | 9/1993 | Samata et al. |
| 5,250,078 | A | | 10/1993 | Saus et al. |
| 5,251,776 | A | | 10/1993 | Morgan, Jr. et al. |
| 5,252,041 | A | * | 10/1993 | Schumack ..... 417/395 |
| 5,259,731 | A | * | 11/1993 | Dhindsa et al. ..... 417/3 |
| 5,261,965 | A | | 11/1993 | Moslehi |
| 5,266,205 | A | | 11/1993 | Fulton et al. |
| 5,267,455 | A | | 12/1993 | Dewees et al. |
| 5,269,815 | A | | 12/1993 | Schlenker et al. |
| 5,269,850 | A | | 12/1993 | Jackson |
| 5,274,129 | A | | 12/1993 | Natale et al. |
| 5,280,693 | A | | 1/1994 | Heudecker |
| 5,285,352 | A | | 2/1994 | Pastore et al. |
| 5,288,333 | A | | 2/1994 | Tanaka et al. |
| 5,290,361 | A | | 3/1994 | Hayashida et al. |
| 5,294,261 | A | | 3/1994 | McDermott et al. |
| 5,298,032 | A | | 3/1994 | Schlenker et al. |
| 5,304,515 | A | | 4/1994 | Morita et al. |
| 5,306,350 | A | | 4/1994 | Hoy et al. |
| 5,312,882 | A | | 5/1994 | DeSimone et al. |
| 5,313,965 | A | | 5/1994 | Palen |
| 5,314,574 | A | | 5/1994 | Takahashi |
| 5,316,591 | A | | 5/1994 | Chao et al. |
| 5,320,742 | A | | 6/1994 | Fletcher et al. |
| 5,328,722 | A | | 7/1994 | Ghanayem et al. |
| 5,334,332 | A | | 8/1994 | Lee |
| 5,334,493 | A | | 8/1994 | Fujita et al. |
| 5,337,446 | A | | 8/1994 | Smith et al. |
| 5,339,844 | A | | 8/1994 | Stanford, Jr. et al. |
| 5,352,327 | A | | 10/1994 | Witowski |
| 5,355,901 | A | | 10/1994 | Mielnik et al. |
| 5,356,538 | A | | 10/1994 | Wai et al. |
| 5,364,497 | A | | 11/1994 | Chau et al. |
| 5,368,171 | A | | 11/1994 | Jackson |
| 5,370,740 | A | | 12/1994 | Chao et al. |
| 5,370,741 | A | | 12/1994 | Bergman |
| 5,370,742 | A | | 12/1994 | Mitchell et al. |
| 5,374,829 | A | | 12/1994 | Sakamoto et al. |
| 5,377,705 | A | | 1/1995 | Smith, Jr. et al. |
| 5,397,220 | A | | 3/1995 | Akihisa et al. ..... 417/369 |
| 5,401,322 | A | | 3/1995 | Marshall |
| 5,403,621 | A | | 4/1995 | Jackson et al. |
| 5,403,665 | A | | 4/1995 | Alley et al. |
| 5,404,894 | A | | 4/1995 | Shiraiwa |
| 5,412,958 | A | | 5/1995 | Iliff et al. |
| 5,417,768 | A | | 5/1995 | Smith, Jr. et al. |
| 5,433,334 | A | | 7/1995 | Reneau |
| 5,434,107 | A | | 7/1995 | Paranjpe ..... 437/225 |
| 5,447,294 | A | | 9/1995 | Sakata et al. |
| 5,456,759 | A | | 10/1995 | Stanford, Jr. et al. |
| 5,470,393 | A | | 11/1995 | Fukazawa |
| 5,474,410 | A | | 12/1995 | Ozawa et al. |
| 5,474,812 | A | | 12/1995 | Truckenmuller et al. |
| 5,482,564 | A | | 1/1996 | Douglas et al. |
| 5,486,212 | A | | 1/1996 | Mitchell et al. |
| 5,494,526 | A | | 2/1996 | Paranjpe |
| 5,500,081 | A | | 3/1996 | Bergman |
| 5,501,761 | A | | 3/1996 | Evans et al. |
| 5,503,176 | A | | 4/1996 | Dunmire et al. |
| 5,505,219 | A | | 4/1996 | Lansberry et al. |

5,509,431 A 4/1996 Smith, Jr. et al.
5,514,220 A 5/1996 Wetmore et al.
5,522,938 A 6/1996 O'Brien
5,526,834 A 6/1996 Mielnik et al.
5,533,538 A 7/1996 Marshall
5,540,554 A * 7/1996 Masuzawa ..... 417/20
5,547,774 A 8/1996 Gimzewski et al.
5,550,211 A 8/1996 DeCrosta et al.
5,571,330 A 11/1996 Kyogoku
5,580,846 A 12/1996 Hayashida et al.
5,589,082 A 12/1996 Lin et al.
5,589,105 A 12/1996 DeSimone et al.
5,589,224 A 12/1996 Tepman et al.
5,621,982 A 4/1997 Yamashita et al.
5,629,918 A 5/1997 Ho et al.
5,632,847 A 5/1997 Ohno et al.
5,635,463 A 6/1997 Muraoka
5,637,151 A 6/1997 Schulz
5,641,887 A 6/1997 Beckman et al.
5,644,855 A 7/1997 McDermott et al.
5,649,809 A 7/1997 Stapelfeldt
5,656,097 A 8/1997 Olesen et al.
5,665,527 A 9/1997 Allen et al.
5,669,251 A 9/1997 Townsend et al.
5,672,204 A 9/1997 Habuka
5,676,705 A 10/1997 Jureller et al.
5,679,169 A 10/1997 Gonzales et al.
5,679,171 A 10/1997 Saga et al.
5,683,473 A 11/1997 Jureller et al.
5,683,977 A 11/1997 Jureller et al.
5,688,879 A 11/1997 DeSimone
5,700,379 A 12/1997 Biebl
5,702,228 A 12/1997 Tamai et al.
5,706,319 A 1/1998 Holtz
5,714,299 A 2/1998 Combes et al.
5,725,987 A 3/1998 Combes et al.
5,726,211 A 3/1998 Hedrick et al.
5,730,874 A 3/1998 Wai et al.
5,736,425 A 4/1998 Smith et al.
5,739,223 A 4/1998 DeSimone
5,746,008 A 5/1998 Yamashita et al.
5,766,367 A 6/1998 Smith et al.
5,769,588 A 6/1998 Toshima et al.
5,772,783 A 6/1998 Stucker
5,783,082 A 7/1998 DeSimone et al.
5,797,719 A * 8/1998 James et al. ..... 417/46
5,798,126 A 8/1998 Fijikawa et al.
5,798,438 A 8/1998 Sawan et al.
5,804,607 A 9/1998 Hedrick et al.
5,807,607 A 9/1998 Smith et al.
5,817,178 A 10/1998 Mita et al.
5,847,443 A 12/1998 Cho et al.
5,850,747 A 12/1998 Roberts et al.
5,858,107 A 1/1999 Chao et al.
5,865,602 A * 2/1999 Nozari ..... 417/44.1
5,866,005 A 2/1999 DeSimone et al.
5,868,856 A 2/1999 Douglas et al.
5,868,862 A 2/1999 Douglas et al.
5,872,061 A 2/1999 Lee et al.
5,872,257 A 2/1999 Beckman et al.
5,873,948 A 2/1999 Kim
5,879,459 A 3/1999 Gadgil et al.
5,881,577 A 3/1999 Sauer et al.
5,882,165 A 3/1999 Maydan et al.
5,888,050 A 3/1999 Fitzgerald et al.
5,893,756 A 4/1999 Berman et al.
5,896,870 A 4/1999 Huynh et al.
5,898,727 A 4/1999 Fujikawa et al.
5,900,107 A 5/1999 Murphy et al.
5,900,354 A 5/1999 Batchelder
5,904,737 A 5/1999 Preston et al.
5,906,866 A 5/1999 Webb
5,908,510 A 6/1999 McCullough et al.
5,928,389 A 7/1999 Jevtic
5,932,100 A 8/1999 Yager et al.
5,934,856 A 8/1999 Asakawa et al.
5,934,991 A 8/1999 Rush
5,943,721 A 8/1999 Lerette et al.
5,944,996 A 8/1999 DeSimone et al.
5,946,945 A 9/1999 Kegler et al.
5,954,101 A 9/1999 Drube et al.
5,955,140 A 9/1999 Smith et al.
5,965,025 A 10/1999 Wai et al.
5,970,554 A 10/1999 Shore et al.
5,971,714 A * 10/1999 Schaffer et al. ..... 417/44.2
5,975,492 A 11/1999 Brenes
5,976,264 A 11/1999 McCullough et al.
5,979,306 A 11/1999 Fujikawa et al.
5,980,648 A 11/1999 Adler
5,981,399 A 11/1999 Kawamura et al.
5,989,342 A 11/1999 Ikeda et al.
5,992,680 A 11/1999 Smith
5,994,696 A 11/1999 Tai et al.
6,005,226 A 12/1999 Aschner et al.
6,017,820 A 1/2000 Ting et al.
6,021,791 A 2/2000 Dryer et al. ..... 134/100.1
6,024,801 A 2/2000 Wallace et al.
6,029,371 A 2/2000 Kamikawa et al.
6,035,871 A 3/2000 Eui-Yeol
6,037,277 A 3/2000 Masakara et al.
6,041,817 A * 3/2000 Guertin ..... 137/565.23
6,045,331 A * 4/2000 Gehm et al. ..... 417/2
6,048,494 A 4/2000 Annapragada
6,053,348 A 4/2000 Morch
6,056,008 A 5/2000 Adams et al.
6,062,853 A 5/2000 Shimazu et al.
6,063,714 A 5/2000 Smith et al.
6,067,728 A 5/2000 Farmer et al.
6,070,440 A 6/2000 Malchow et al.
6,077,053 A 6/2000 Fujikawa et al.
6,077,321 A 6/2000 Adachi et al.
6,082,150 A 7/2000 Stucker
6,085,935 A 7/2000 Malchow et al.
6,089,377 A 7/2000 Shimizu
6,097,015 A 8/2000 McCullough et al.
6,099,619 A 8/2000 Lansbarkis et al.
6,100,198 A 8/2000 Grieger et al.
6,103,638 A 8/2000 Robinson ..... 438/778
6,109,296 A 8/2000 Austin
6,110,232 A 8/2000 Chen et al.
6,114,044 A 9/2000 Houston et al.
6,122,566 A 9/2000 Nguyen et al.
6,123,510 A * 9/2000 Greer et al. ..... 417/53
6,128,830 A 10/2000 Bettcher et al.
6,140,252 A 10/2000 Cho et al.
6,145,519 A 11/2000 Konishi et al.
6,149,828 A 11/2000 Vaartstra
6,159,295 A 12/2000 Maskara et al.
6,164,297 A 12/2000 Kamikawa
6,171,645 B1 1/2001 Smith et al.
6,186,722 B1 2/2001 Shirai
6,190,459 B1 2/2001 Takeshita et al. ..... 118/715
6,200,943 B1 3/2001 Romack et al.
6,203,582 B1 3/2001 Berner et al.
6,216,364 B1 4/2001 Tanaka et al.
6,224,774 B1 5/2001 DeSimone et al.
6,228,563 B1 5/2001 Starov et al.
6,228,826 B1 5/2001 DeYoung et al.
6,232,238 B1 5/2001 Chang et al.
6,232,417 B1 5/2001 Rhodes et al.
6,235,634 B1 5/2001 White et al.
6,239,038 B1 5/2001 Wen
6,241,825 B1 6/2001 Wytman
6,242,165 B1 6/2001 Vaartstra
6,244,121 B1 6/2001 Hunter
6,251,250 B1 6/2001 Keigler 6,255,732 B1 7/2001 Yokoyama et al.
6,262,510 B1 7/2001 Lungu ..... 310/254
6,264,753 B1 7/2001 Chao et al.
6,270,531 B1 8/2001 DeYoung et al.
6,270,948 B1 8/2001 Sato et al.
6,277,753 B1 8/2001 Mullee et al.
6,284,558 B1 9/2001 Sakamoto
6,286,231 B1 9/2001 Bergman et al.
6,305,677 B1 10/2001 Lenz
6,306,564 B1 10/2001 Mullee
6,319,858 B1 11/2001 Lee et al.
6,331,487 B1 12/2001 Koch
6,333,268 B1 12/2001 Starov et al.
6,334,266 B1 1/2002 Moritz et al.
6,344,174 B1 2/2002 Miller et al.
6,344,243 B1 2/2002 McClain et al.
6,355,072 B1 3/2002 Racette et al.
6,358,673 B1 3/2002 Namatsu
6,361,696 B1 3/2002 Spiegelman et al.
6,363,292 B1 * 3/2002 McLoughlin ..... 700/121
6,367,491 B1 4/2002 Marshall et al.
6,380,105 B1 4/2002 Smith et al.
6,388,317 B1 5/2002 Reese
6,389,677 B1 5/2002 Lenz
6,406,782 B1 6/2002 Johnson et al.
6,418,956 B1 7/2002 Bloom
6,425,956 B1 7/2002 Cotte et al.
6,436,824 B1 8/2002 Chooi et al.
6,454,519 B1 9/2002 Toshima et al.
6,454,945 B1 9/2002 Weigl et al.
6,458,494 B1 10/2002 Song et al.
6,461,967 B1 10/2002 Wu et al.
6,464,790 B1 10/2002 Shertinsky et al.
6,465,403 B1 10/2002 Skee
6,485,895 B1 11/2002 Choi et al.
6,486,078 B1 11/2002 Rangarajan et al.
6,492,090 B1 12/2002 Nishi et al.
6,500,605 B1 12/2002 Mullee et al.
6,508,259 B1 1/2003 Tseronis et al.
6,509,141 B1 1/2003 Mullee
6,521,466 B1 2/2003 Castrucci
6,532,772 B1 3/2003 Robinson ..... 65/182.2
6,537,916 B1 3/2003 Mullee et al. ..... 438/692
6,541,278 B1 4/2003 Morita et al.
6,546,946 B1 4/2003 Dunmire
6,550,484 B1 4/2003 Gopinath et al.
6,558,475 B1 5/2003 Jur et al.
6,561,213 B1 5/2003 Wang et al.
6,561,220 B1 5/2003 McCullough et al.
6,561,481 B1 5/2003 Filonczuk
6,561,767 B1 5/2003 Biberger et al.
6,562,146 B1 5/2003 DeYoung et al.
6,564,826 B1 5/2003 Shen
6,596,093 B1 7/2003 DeYoung et al.
6,612,317 B1 9/2003 Costantini et al.
6,613,105 B1 9/2003 Moore ..... 29/25.01
6,616,414 B1 * 9/2003 Yoo et al. ..... 417/44.1
6,635,565 B1 10/2003 Wu et al.
6,641,678 B1 11/2003 DeYoung et al.
6,642,140 B1 11/2003 Moore ..... 438/631
6,722,642 B1 4/2004 Sutton et al.
6,736,149 B1 5/2004 Biberger et al.
6,764,212 B1 7/2004 Nitta et al. ..... 366/114
6,764,552 B1 7/2004 Joyce et al. ..... 134/3
6,805,801 B1 10/2004 Humayun et al.
6,815,922 B1 * 11/2004 Yoo et al. ..... 318/632
6,851,148 B1 2/2005 Preston et al.
6,874,513 B1 4/2005 Yamagata et al.
6,890,853 B1 5/2005 Biberger et al.
6,921,456 B1 7/2005 Biberger et al.
6,966,967 B1 * 11/2005 Curry et al. ..... 156/345.26
7,044,143 B1 5/2006 DeYoung et al. ..... 134/105
2001/0019857 A1 9/2001 Yokoyama
2001/0024247 A1 9/2001 Nakata
2001/0041455 A1 11/2001 Yun et al.
2001/0041458 A1 11/2001 Ikakura et al.
2001/0050096 A1 12/2001 Costantini et al.
2002/0001929 A1 1/2002 Biberger et al.
2002/0046707 A1 4/2002 Biberger et al.
2002/0055323 A1 5/2002 McClain et al.
2002/0074289 A1 6/2002 Sateria et al.
2002/0081533 A1 6/2002 Simons et al.
2002/0088477 A1 7/2002 Cotte et al.
2002/0098680 A1 7/2002 Goldstein et al.
2002/0106867 A1 8/2002 Yang et al.
2002/0112740 A1 8/2002 DeYoung et al.
2002/0112746 A1 8/2002 DeYoung et al.
2002/0115022 A1 8/2002 Messick et al.
2002/0117391 A1 8/2002 Beam
2002/0123229 A1 9/2002 Ono et al.
2002/0127844 A1 9/2002 Grill et al.
2002/0132192 A1 9/2002 Namatsu
2002/0141925 A1 10/2002 Wong et al.
2002/0142595 A1 10/2002 Chiou
2002/0150522 A1 10/2002 Heim et al.
2002/0164873 A1 11/2002 Masuda et al. ..... 438/689
2002/0189543 A1 12/2002 Biberger et al.
2003/0003762 A1 1/2003 Cotte et al.
2003/0008238 A1 1/2003 Goldfarb et al.
2003/0008518 A1 1/2003 Chang et al.
2003/0013311 A1 1/2003 Chang et al.
2003/0036023 A1 2/2003 Moreau et al.
2003/0047533 A1 3/2003 Reid et al.
2003/0051741 A1 3/2003 DeSimone et al.
2003/0106573 A1 6/2003 Masuda et al. ..... 134/26
2003/0125225 A1 7/2003 Xu et al. ..... 510/175
2003/0161734 A1 * 8/2003 Kim ..... 417/44.1
2003/0198895 A1 10/2003 Toma et al.
2003/0205510 A1 11/2003 Jackson
2003/0217764 A1 11/2003 Masuda et al. ..... 134/26
2004/0011386 A1 1/2004 Seghal
2004/0020518 A1 2/2004 DeYoung et al.
2004/0087457 A1 5/2004 Korzenski et al. ..... 510/177
2004/0103922 A1 6/2004 Inoue et al. ..... 134/26
2004/0112409 A1 6/2004 Schilling ..... 134/26
2004/0134515 A1 7/2004 Castrucci
2004/0157463 A1 8/2004 Jones
2004/0177867 A1 9/2004 Schilling ..... 134/26
2004/0213676 A1 * 10/2004 Phillips et al. ..... 417/44.11
2004/0259357 A1 12/2004 Saga
2005/0014370 A1 1/2005 Jones
2005/0026547 A1 * 2/2005 Moore et al. ..... 451/5
2005/0111987 A1 * 5/2005 Yoo et al. ..... 417/44.11
2005/0141998 A1 * 6/2005 Yoo et al. ..... 417/44.1
2005/0158178 A1 * 7/2005 Yoo et al. ..... 417/45
2005/0191184 A1 * 9/2005 Vinson, Jr. ..... 417/44.2
2006/0003592 A1 1/2006 Gale et al. ..... 438/745
2006/0130966 A1 * 6/2006 Babic et al. ..... 156/345.1

FOREIGN PATENT DOCUMENTS

CN 1399790 A 2/2003
DE 36 08 783 A1 7/1987
DE 39 04 514 C2 8/1990
DE 40 04 111 C2 8/1990
DE 39 06 724 C2 9/1990
DE 39 06 735 C2 9/1990
DE 39 06 737 A1 9/1990
DE 44 29 470 A1 3/1995
DE 43 44 021 A1 6/1995
DE 198 60 084 A1 7/2000
EP 0 244 951 A2 11/1987
EP 0 272 141 A2 6/1988
EP 0 283 740 A2 9/1988
EP 0 302 345 A2 2/1989
EP 0 370 233 A1 5/1990

| | | | |
|---|---|---|---|
| EP | 0 391 035 | A2 | 10/1990 |
| EP | 0 453 867 | A1 | 10/1991 |
| EP | 0 518 653 | B1 | 12/1992 |
| EP | 0 536 752 | A2 | 4/1993 |
| EP | 0 572 913 | A1 | 12/1993 |
| EP | 0 587 168 | A1 | 3/1994 |
| EP | 0 620 270 | A3 | 10/1994 |
| EP | 0 679 753 | B1 | 11/1995 |
| EP | 0 711 864 | B1 | 5/1996 |
| EP | 0 726 099 | A2 | 8/1996 |
| EP | 0 727 711 | A2 | 8/1996 |
| EP | 0 743 379 | A1 | 11/1996 |
| EP | 0 822 583 | A2 | 2/1998 |
| EP | 0 829 312 | A2 | 3/1998 |
| EP | 0 836 895 | A2 | 4/1998 |
| EP | 0 903 775 | A2 | 3/1999 |
| FR | 1.499.491 | | 9/1967 |
| GB | 2 003 975 | | 3/1979 |
| GB | 2 193 482 | | 2/1988 |
| JP | 56-142629 | | 11/1981 |
| JP | 60-192333 | | 9/1985 |
| JP | 60-238479 | | 11/1985 |
| JP | 60-246635 | | 12/1985 |
| JP | 61-231166 | | 10/1986 |
| JP | 62-111442 | | 5/1987 |
| JP | 62-125619 | | 6/1987 |
| JP | 63-179530 | | 7/1988 |
| JP | 63-256326 | | 10/1988 |
| JP | 63-303059 | | 12/1988 |
| JP | 1-045131 | | 2/1989 |
| JP | 1-246835 | | 10/1989 |
| JP | 2-148841 | | 6/1990 |
| JP | 2-209729 | | 8/1990 |
| JP | 2-304941 | | 12/1990 |
| JP | 4-17333 | | 1/1992 |
| JP | 4-284648 | | 10/1992 |
| JP | 40 5283511 | A | 10/1993 |
| JP | 7-142333 | | 6/1995 |
| JP | 7-283104 | | 10/1995 |
| JP | 8-186140 | | 7/1996 |
| JP | 8-206485 | | 8/1996 |
| JP | 8-222508 | | 8/1996 |
| JP | 8-252549 | | 10/1996 |
| JP | 9-43857 | | 2/1997 |
| JP | 10-144757 | | 5/1998 |
| JP | 10-260537 | | 9/1998 |
| JP | 10-335408 | | 12/1998 |
| JP | 11-200035 | | 7/1999 |
| JP | 11-274132 | | 10/1999 |
| JP | 2000/106358 | | 4/2000 |
| JP | 2001-77074 | | 3/2001 |
| WO | WO 87/07309 | | 12/1987 |
| WO | WO 90/06189 | | 6/1990 |
| WO | WO 90/13675 | | 11/1990 |
| WO | WO 91/12629 | | 8/1991 |
| WO | WO 93/14255 | | 7/1993 |
| WO | WO 93/14259 | | 7/1993 |
| WO | WO 93/20116 | | 10/1993 |
| WO | WO 96/27704 | | 9/1996 |
| WO | WO 99/18603 | | 4/1999 |
| WO | WO 99/49998 | | 10/1999 |
| WO | WO 00/36635 | | 6/2000 |
| WO | WO 00/73241 | A1 | 12/2000 |
| WO | WO 01/10733 | A1 | 2/2001 |
| WO | WO 01/22016 | A1 | 3/2001 |
| WO | WO 01/33613 | A2 | 5/2001 |
| WO | WO 01/33615 | A3 | 5/2001 |
| WO | WO 01/55628 | A1 | 8/2001 |
| WO | WO 01/68279 | A2 | 9/2001 |
| WO | WO 01/74538 | A1 | 10/2001 |
| WO | WO 01/78911 | A1 | 10/2001 |
| WO | WO 01/85391 | A2 | 11/2001 |
| WO | WO 01/94782 | A3 | 12/2001 |
| WO | WO 02/09147 | A2 | 1/2002 |
| WO | WO 02/09894 | A2 | 2/2002 |
| WO | WO 02/11191 | A2 | 2/2002 |
| WO | WO 02/16051 | A2 | 2/2002 |
| WO | WO 03/030219 | A2 | 10/2003 |

OTHER PUBLICATIONS

"Los Almos National Laboratory," Solid State Technology, pp. S10 & S14, Oct. 1998.

"Supercritical Carbon Dioxide Resist Remover, SCORR, the Path to Least Photoresistance," Los Alamos National Laboratory, 1998.

Guan, Z. et al., "Fluorocarbon-Based Heterophase Polymeric Materials. 1. Block Copolymer Surfactants for Carbon Dioxide Applications," Macromolecules, vol. 27, 1994, pp. 5527-5532.

International Journal of Environmentally Conscious Design & Manufacturing, vol. 2, No. 1, 1993, p. 83.

Matson and Smith "Supercritical Fluids", Journal of the American Ceramic Society, vol. 72, No. 6, pp. 872-874.

Ziger, D.H. et al., "Compressed Fluid Technology: Application to RIE Developed Resists," AIChE Journal, vol. 33, No. 10, Oct. 1987, pp. 1585-1591.

Kirk-Othmer, "Alcohol Fuels to Toxicology," Encyclopedia of Chemical Terminology, 3rd ed., Supplement Volume, New York: John Wiley & Sons, 1984, pp. 872-893.

"Cleaning with Supercritical $CO_2$," NASA Tech Briefs, MFS-29611, Marshall Space Flight Center, Alabama, Mar. 1979.

Basta, N., "Supercritical Fluids: Sill Seeking Acceptance," Chemical Engineering, vol. 92, No. 3, Feb. 24, 1985, p. 14.

Takahashi, D., "Los Alamos Lab Finds Way to Cut Chip Toxic Waste," Wall Street Journal, Jun. 22, 1998.

"Supercritical CO2 Process Offers Less Mess from Semiconductor Plants", Chemical Engineering Magazine, pp. 27 & 29, Jul. 1998.

Sun, Y.P. et al., "Preparation of Polymer-Protected Semiconductor Nanoparticles Through the Rapid Expansion of Supercritical Fluid Solution," Chemical Physics Letters, pp. 585-588, May 22, 1998.

Jackson, K. et al., "Surfactants and Micromulsions in Supercritical Fluids," Supercritical Fluid Cleaning. Noyes Publications, Westwood, NJ, pp. 87-120, Spring 1998.

Kryszewski, M., "Production of Metal and Semiconductor Nanoparticles in Polymer Systems," Polimery, pp. 65-73, Feb. 1998.

Bakker, G.L. et al., "Surface Cleaning and Carbonaceous Film Removal Using High Pressure, High Temperature Water, and Water/C02 Mixtures," J. Electrochem. Soc, vol. 145, No. 1, pp. 284-291, Jan. 1998.

Ober, C.K. et al., "Imaging Polymers with Supercritical Carbon Dioxide," Advanced Materials, vol. 9, No. 13, 1039-1043, Nov. 3, 1997.

Russick, E.M. et al., "Supercritical Carbon Dioxide Extraction of Solvent from Micro-machined Structures." Supercritical Fluids Extraction and Pollution Prevention, ACS Symposium Series, vol. 670, pp. 255-269,Oct. 21, 1997.

Dahmen, N. et al., "Supercritical Fluid Extraction of Grinding and Metal Cutting Waste Contaminated with Oils," Supercritical Fluids—Extraction and Pollution Prevention, ACS Symposium Series, vol. 670, pp. 270-279, Oct. 21, 1997.

Wai, C.M., "Supercritical Fluid Extraction: Metals as Complexes," Journal of Chromatography A, vol. 785, pp. 369-383, Oct. 17, 1997.

Xu, C. et al., "Submicron-Sized Spherical Yttrium Oxide Based Phosphors Prepared by Supercritical CO2-Assisted aerosolization and pyrolysis," Appl. Phys. Lett., vol. 71, No. 12, Sep. 22, 1997, pp. 1643-1645.

Tomioka Y, et al., "Decomposition of Tetramethylammonium (TMA) in a Positive Photo-resist Developer by Supercritical Water," Abstracts of Papers 214th ACS Natl Meeting, American Chemical Society, Abstract No. 108, Sep. 7, 1997.

Klein, H. et al., "Cyclic Organic Carbonates Serve as Solvents and Reactive Diluents," Coatings World, pp. 38-40, May 1997.

Bühler, J. et al., Linear Array of Complementary Metal Oxide Semiconductor Double-Pass Metal Micro-mirrors, Opt. Eng., vol. 36, No. 5, pp. 1391-1398, May 1997.

Jo, M.H. et al., Evaluation of SIO2 Aerogel Thin Film with Ultra Low Dielectric Constant as an Intermetal Dielectric, Microelectronic Engineering, vol. 33, pp. 343-348, Jan. 1997.
McClain, J.B. et al., "Design of Nonionic Surfactants for Supercritical Carbon Dioxide," Science, vol. 274, Dec. 20, 1996. pp. 2049-2052.
Znaidi, L. et al., "Batch and Semi-Continuous Synthesis of Magnesium Oxide Powders from Hydrolysis and Supercritical Treatment of Mg(OCH3)2," Materials Research Bulletin, vol. 31, No. 12, pp. 1527-1335, Dec. 1996.
Tadros, M.E., "Synthesis of Titanium Dioxide Particles in Supercritical CO2," J. Supercritical Fluids, vol. 9, pp. 172-176, Sep. 1996.
Courtecuisse, V.G. et al., "Kinetics of the Titanium Isopropoxide Decomposition in Supercritical Isopropyl Alcohol," Ind. Eng. Chem. Res., vol. 35, No. 8, pp. 2539-2545, Aug. 1996.
Gabor, A, et al., "Block and Random Copolymer resists Designed for 193 nm Lithography and Environmentally Friendly Supercritical CO2 Development,", SPIE, vol. 2724, pp. 410-417, Jun. 1996.
Schimek, G. L. et al., "Supercritical Ammonia Synthesis and Characterization of Four New Alkali Metal Silver Antimony Sulfides . . . ," J. Solid State Chemistry, vol. 123 pp. 277-284, May 1996.
Gallagher-Wetmore, P. et al., "Supercritical Fluid Processing: Opportunities for New Resist Materials and Processes," SPIE, vol. 2725, pp. 289-299, Apr. 1996.
Papathomas, K.I. et al., "Debonding of Photoresists by Organic Solvents," J. Applied Polymer Science, vol. 59, pp. 2029-2037, Mar. 28, 1996.
Watkins, J.J. et al., "Polymer/metal Nanocomposite Synthesis in Supercritical CO2," Chemistry of Materials, vol. 7, No. 11, Nov. 1995., pp. 1991-1994.
Gloyna, E.F. et al., "Supercritical Water Oxidation Research and Development Update," Environmental Progress, vol. 14, No. 3. pp. 182-192, Aug. 1995.
Gallagher-Wetmore, P. et al., "Supercritical Fluid Processing: A New Dry Technique for Photoresist Developing," SPIE vol. 2438, pp. 694-708, Jun. 1995.
Gabor, A. H. et al., "Silicon-Containing Block Copolymer Resist Materials," Microelectronics Technology—Polymers for Advanced Imaging and Packaging, ACS Symposium Series, vol. 614, pp. 281-298, Apr. 1995.
Tsiartas, P.C. et al., "Effect of Molecular weight Distribution on the Dissolution Properties of Novolac Blends," SPIE, vol. 2438, pp. 264-271, Jun. 1995.
Allen, R.D. et al., "Performance Properties of Near-monodisperse Novolak Resins,"SPIE, vol. 2438, pp. 250-260, Jun. 1995.
Wood, P.T. et al., "Synthesis of New Channeled Structures in Supercritical Amines . . . ," Inorg. Chem., vol. 33, pp. 1556-1558, 1994.
Jerome, J.E. et al., "Synthesis of New Low-Dimensional Quaternary Compounds . . . ," Inorg. Chem, vol. 33, pp. 1733-1734, 1994.
McHardy, J. et al., "Progress in Supercritical CO2 Cleaning," SAMPE Jour., vol. 29, No. 5, Sep. 20-27, 1993.
Purtell, R, et al., "Precision Parts Cleaning using Supercritical Fluids," J. Vac, Sci, Technol. A. vol. 11, No. 4, Jul. 1993, pp. 1696-1701.
Bok, E, et al., "Supercritical Fluids for Single Wafer Cleaning," Solid State Technology, pp. 117-120, Jun. 1992.
Adschiri, T. et al., "Rapid and Continuous Hydrothermal Crystallization of Metal Oxide Particles in Supercritical Water," J. Am. Ceram. Soc., vol. 75, No. 4, pp. 1019-1022, 1992.
Hansen, B.N. et al., "Supercritical Fluid Transport—Chemical Deposition of Films,"Chem. Mater., vol. 4, No. 4, pp. 749-752, 1992.
Page, S.H. et al., "Predictability and Effect of Phase Behavior of CO2/ Propylene Carbonate in Supercritical Fluid Chromatography," J. Microcol, vol. 3, No. 4, pp. 355-369, 1991.
Brokamp, T. et al., "Synthese und Kristallstruktur Eines Gemischtvalenten Lithium-Tantalnitrids Li2Ta3N5," J. Alloys and Compounds, vol. 176. pp. 47-60, 1991.
Hybertson, B.M. et al., "Deposition of Palladium Films by a Novel Supercritical Fluid Transport Chemical Deposition Process," Mat. Res. Bull., vol. 26, pp. 1127-1133, 1991.
Ziger, D. H. et al., "Compressed Fluid Technology: Application to RIE-Developed Resists," AiChE Jour., vol. 33, No. 10, pp. 1585-1591, Oct. 1987.
Matson, D.W. et al., "Rapid Expansion of Supercritical Fluid Solutions: Solute Formation of Powders, Thin Films, and Fibers," Ind. Eng. Chem. Res., vol. 26, No. 11, pp. 2298-2306, 1987.
Tolley, W.K. et al., "Stripping Organics from Metal and Mineral Surfaces using Supercritical Fluids," Separation Science and Technology, vol. 22, pp. 1087-1101, 1987.
"Final Report on the Safety Assessment of Propylene Carbonate", J. American College of Toxicology, vol. 6, No. 1, pp. 23-51, 1987.
"Porous Xerogel Films as Ultra-Low Permittivity Dielectrics for ULSI Interconnect Applications", Material Research Society, pp. 463-469, 1997.
Kawakami et al., "A Super Low-k (k=1.1) Silica Aerogel Film Using Supercritical Drying Technique", IEEE, pp. 143-145, 2000.
R.F. Reidy, "Effects of Supercritical Processing on Ultra Low-K Films", Texas Advanced Technology Program, Texas Instruments, and the Texas Academy of Mathematics and Science.
Anthony Muscat, "Backend Processing Using Supercritical CO2", University of Arizona.
D. Goldfarb et al., "Aqueous-based Photoresist Drying Using Supercritical Carbon Dioxide to Prevent Pattern Collapse", J. Vacuum Sci. Tech. B 18 (6), 3313 (2000).
H. Namatsu et al., "Supercritical Drying for Water-Rinsed Resist Systems", J. Vacuum Sci. Tech. B 18 (6), 3308 (2000).
N. Sundararajan et al., "Supercritical CO2 Processing for Submicron Imaging of Fluoropolymers", Chem. Mater. 12, 41 (2000).
Hideaki Itakura et al., "Multi-Chamber Dry Etching System", Solid State Technology, Apr. 1982, pp. 209-214.
Joseph L. Foszcz, "Diaphragm Pumps Eliminate Seal Problems", Plant Engineering , pp. 1-5, Feb. 1, 1996.
Bob Agnew, "WILDEN Air-Operated Diaphragm Pumps", Process & Industrial Training Technologies, Inc., 1996.
US 6,001,133, 12/1999, DeYoung et al. (withdrawn)
US 6,486,282, 11/2002, Dammel et al. (withdrawn)

* cited by examiner

CONTROL OF FLUID FLOW IN THE PROCESSING OF AN OBJECT WITH A FLUID

FIELD OF THE INVENTION

The present invention in general relates to the field of semiconductor wafer processing. More particularly, the present invention relates to methods and apparatus for control of fluid flow in the processing of semiconductor wafers and other objects.

BACKGROUND OF THE INVENTION

The capacity and pressure requirements of a system can be shown with the use of a graph called a system, curve. Similarly, a capacity versus pressure variation graph can be used to show a given pump's performance. As used herein, "capacity" means the flow rate with which fluid is moved or pushed by a pump, which is measured in units of volume per unit time, e.g., gallons per minute. The term "pressure" relative to fluids generally means the force per unit area that a fluid exerts on its surroundings. Pressure can depend on flow and other factors such as compressibility of the fluid and external forces. When the fluid is not in motion, that is, not being pumped or otherwise pushed or moved, the pressure is referred to as static pressure. If the fluid is in motion, the pressure that it exerts on its surroundings is referred to as dynamic pressure, which depends on the motion.

The variety of conditions, ranges, and fluids for which it can be desirable to measure pressure has given rise to numerous types of pressure sensors or transducers, such as but not limited to gage sensors, vacuum sensors, differential pressure sensors, absolute pressure sensors, barometric sensors, piezoelectric pressure sensors, variable-impedance transducers, and resistive pressure sensors. One problem with the use of pressure transducers is that, depending on the composition and materials used in the transducer and the composition of the fluid being measured, the transducer can break down and contaminate the system. Another problem with the use of pressure transducers is that their accuracy can vary both with temperature changes and over time. Temperature changes and large pressure changes typically occur during semiconductor wafer processing with supercritical fluids. During wafer processing, the unreliable accuracy of pressure sensors can adversely impact quality control and affect yield. It would be advantageous to have a fluid flow control system that does not include pressure transducers. It would be desirable to eliminate the need for using pressure transducers in controlling the flow of a fluid during semiconductor wafer processing.

Flow meters are commonly used to measure a fluid flow in the processing of semiconductor wafers and other objects. Problems commonly associated with flow meters include clogging, contamination, leaks, and maintenance costs. It would be advantageous to have a fluid flow control system that does not include flow meters. It would be desirable to reduce contamination in semiconductor wafer processing by elimination of the contamination typically associated with the use of flow meters.

The use of pumps in the processing of semiconductor wafers and other objects is known. Pumps induce fluid flow. The term "head" is commonly used to measure the kinetic energy produced by a pump. By convention, head refers to the static pressure produced by the weight of a vertical column of fluid above the point at which the pressure is being described-this column's height is called the static head and is expressed in terms of length, e.g., feet, of liquid.

"Head" is not equivalent to the "pressure." Pressure has units of force per unit area, e.g., pound per square inch, whereas head has units of length or feet. Head is used instead of pressure to measure the energy of a pump because, while the pressure of a pump will change if the specific gravity (weight) of the fluid changes, the head will not change. Since it can be desirable to pump different fluids, with different specific gravities, it is simpler to discuss the head developed by the pump, as opposed to pressure, neglecting the issue of the specific gravity of the fluid. It would be desirable to have a fluid flow control system that includes a pump.

There are numerous considerations and design criteria for pump systems. Pump performance curves have been used as tools in the design and analysis of pump systems. FIG. 1 is a representative illustration of a pump performance curve for a centrifugal pump with various impeller diameters, for the purpose of showing the relationship between the capacity (flow rate) and total dynamic head of an exemplary pump in the prior art. As a general rule with centrifugal pumps, an increase in flow causes a decrease in head. Typically, a pump performance curve also shows the rotational speed in revolutions per minute, net positive suction head (NPSH) required, which is the amount of NPSH the pump requires to avoid cavitation, power requirements, and other information such as pump type, pump size, and impeller size. For example, the pump size, 1½×3-6, shown in the upper part of the centrifugal pump curve illustrated in FIG. 1, indicates a 1½ inch discharge port, a 3 inch suction port, and a maximum nominal impeller size of 6 inches. As depicted in FIG. 1, the several curves that slope generally downward from left to right across the graph show the actual performance of the pump at various impeller diameters. Pump system performance can vary for every application based on the slope of the pump performance curve and its relationship with any specific system curve.

What is needed is an apparatus for and method of controlling a fluid flow for use in the processing of an object with a fluid, such that contaminants in the fluid are minimized. What is needed is an apparatus for and method of controlling a fluid flow that does not include flow meters for controlling the fluid flow. What is needed is an apparatus for and method of controlling a fluid flow that does not include pressure transducers for controlling the fluid flow.

SUMMARY OF THE INVENTION

In a first embodiment of the present invention, an apparatus for control of a fluid flow includes a measuring means for measuring a pump performance parameter and a controller means for adjusting a fluid flow in response to in the pump performance parameter.

In a second embodiment of the invention, an apparatus for control of a fluid flow includes a measuring means for measuring a pump performance parameter and a means for comparing a measured pump performance parameter to a predetermined target pump performance parameter. The apparatus also includes a controller means for adjusting a fluid flow in response to a difference in the measured pump performance parameter and the predetermined target pump performance parameter.

In a third embodiment of the invention, an apparatus for control of a fluid flow includes a pump and a sensor for measuring a pump performance parameter. The apparatus also includes a controller for adjusting operation of the pump to control a fluid flow in response to the pump performance parameter.

In a fourth embodiment, a system for supercritical processing of an object includes a means for performing a supercritical process. The system also includes a means for measuring a pump performance parameter and a means for adjusting operation of a pump to control a fluid flow in response to the pump performance parameter.

In a fifth embodiment, a method of control of a fluid flow comprises the steps of measuring a pump performance parameter and adjusting a fluid flow in response to the pump performance parameter.

In a sixth embodiment, a method of eliminating flow meter contamination in semiconductor wafer processing with a fluid comprises the steps of measuring a pump operational parameter and adjusting operation of a pump to control a fluid flow in response to the pump operational parameter.

In a seventh embodiment, a method of control of a fluid flow includes the step of measuring a pump performance parameter. The method also includes the steps of comparing a measured pump performance parameter to a predetermined target pump performance parameter and adjusting a fluid flow in response to a difference in the measured pump performance parameter and the predetermined target pump performance parameter.

In an eighth embodiment, a method of control of a fluid flow in a supercritical processing system includes the steps of defining a system curve including a point of operation and using the system curve to define at least one of a predetermined pump speed, voltage, electric current, and electric power. The method includes the step of measuring performance of a pump to obtain at least one of a measured pump speed, voltage, electric current, and electric power. The method also includes the steps of comparing at least one of a measured pump speed, voltage, electric current, and electric power to at least one of a predetermined pump speed, voltage, electric current, and electric power and adjusting operation of a pump to control a fluid flow in response to a difference in at least one of a measured pump speed, voltage, electric current, and electric power and at least one of a predetermined pump speed, voltage, electric current, and electric power.

BRIEF DESCRIPTION OF THE DRAWINGS

The present invention may be better understood by reference to the accompanying drawings of which.

DETAILED DESCRIPTION OF THE PREFERRED EMBODIMENTS

The present invention is directed to an apparatus for and methods of control of a fluid flow. For the purposes of the invention and this disclosure, "fluid" means a gaseous, liquid, supercritical and/or near-supercritical fluid. In certain embodiments of the invention, "fluid" means gaseous, liquid, supercritical and/or near-supercritical carbon dioxide. It should be appreciated that solvents, co-solvents, chemistries, and/or surfactants can be contained in the carbon dioxide. For purposes of the invention, "carbon dioxide" should be understood to refer to carbon dioxide ($CO_2$) employed as a fluid in a liquid, gaseous or supercritical (including near-supercritical) state. "Supercritical carbon dioxide" refers herein to $CO_2$ at conditions above the critical temperature (30.5° C.) and critical pressure (7.38 MPa). When $CO_2$ is subjected to pressures and temperatures above 7.38 MPa and 30.5° C., respectively, it is determined to be in the supercritical state. "Near-supercritical carbon dioxide" refers to $CO_2$ within about 85% of critical temperature and critical pressure. For the purposes of the invention, "object" typically refers to a semiconductor wafer for forming integrated circuits, a substrate and other media requiring low contamination levels. As used herein, "substrate" includes a wide variety of structures such as semiconductor device structures typically with a deposited photoresist or residue. A substrate can be a single layer of material, such as a silicon wafer, or can include any number of layers. A substrate can comprise various materials, including metals, ceramics, glass, or compositions thereof.

Figure 1:
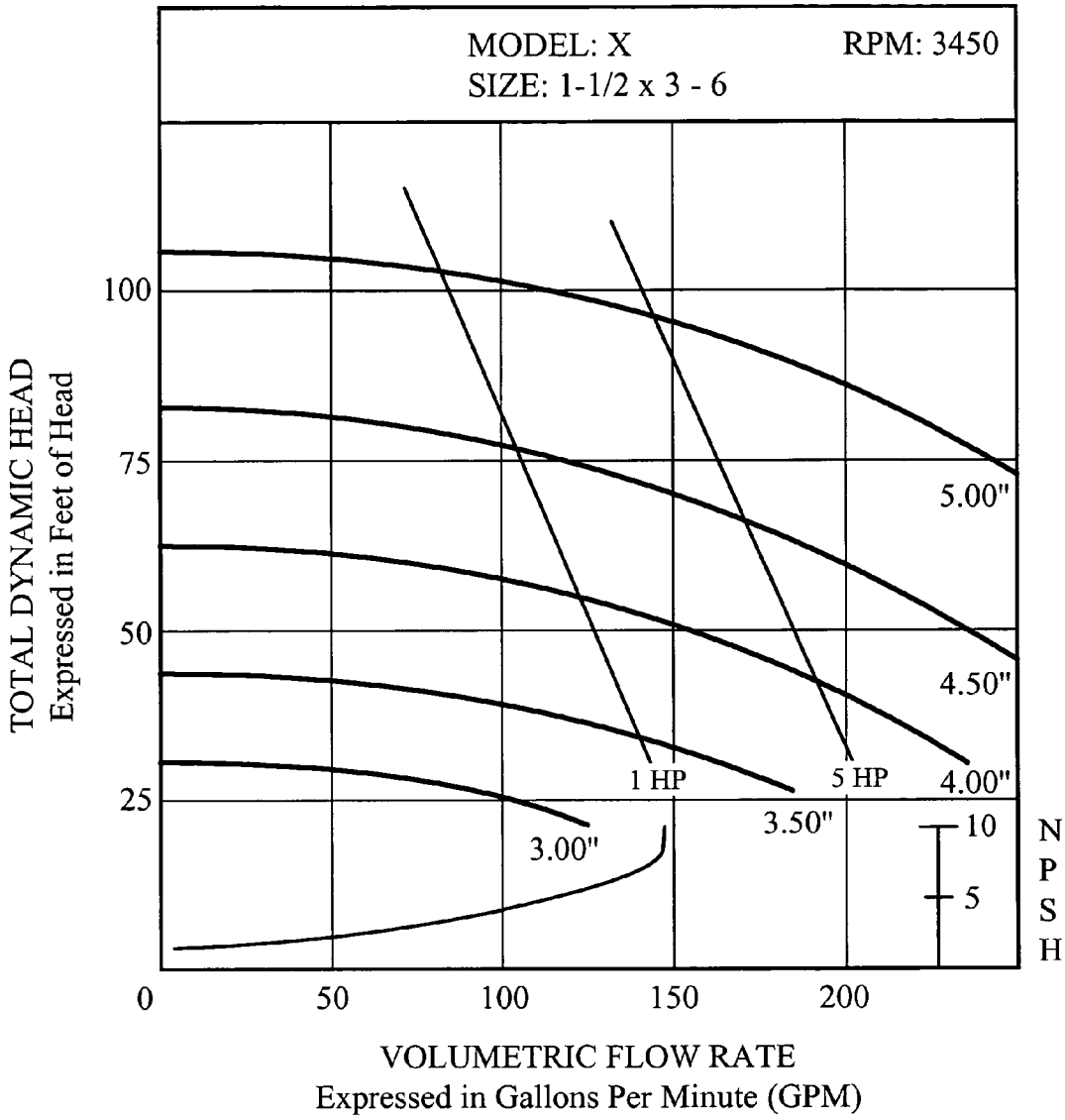
Fig. 1 (PRIOR ART)
FIG. 1 is an representative illustration of a pump performance curve for an centrifugal pump with various impeller diameters, for the purpose of showing the relationship between the capacity and total dynamic head of an exemplary pump in the prior art.
Figure 2:
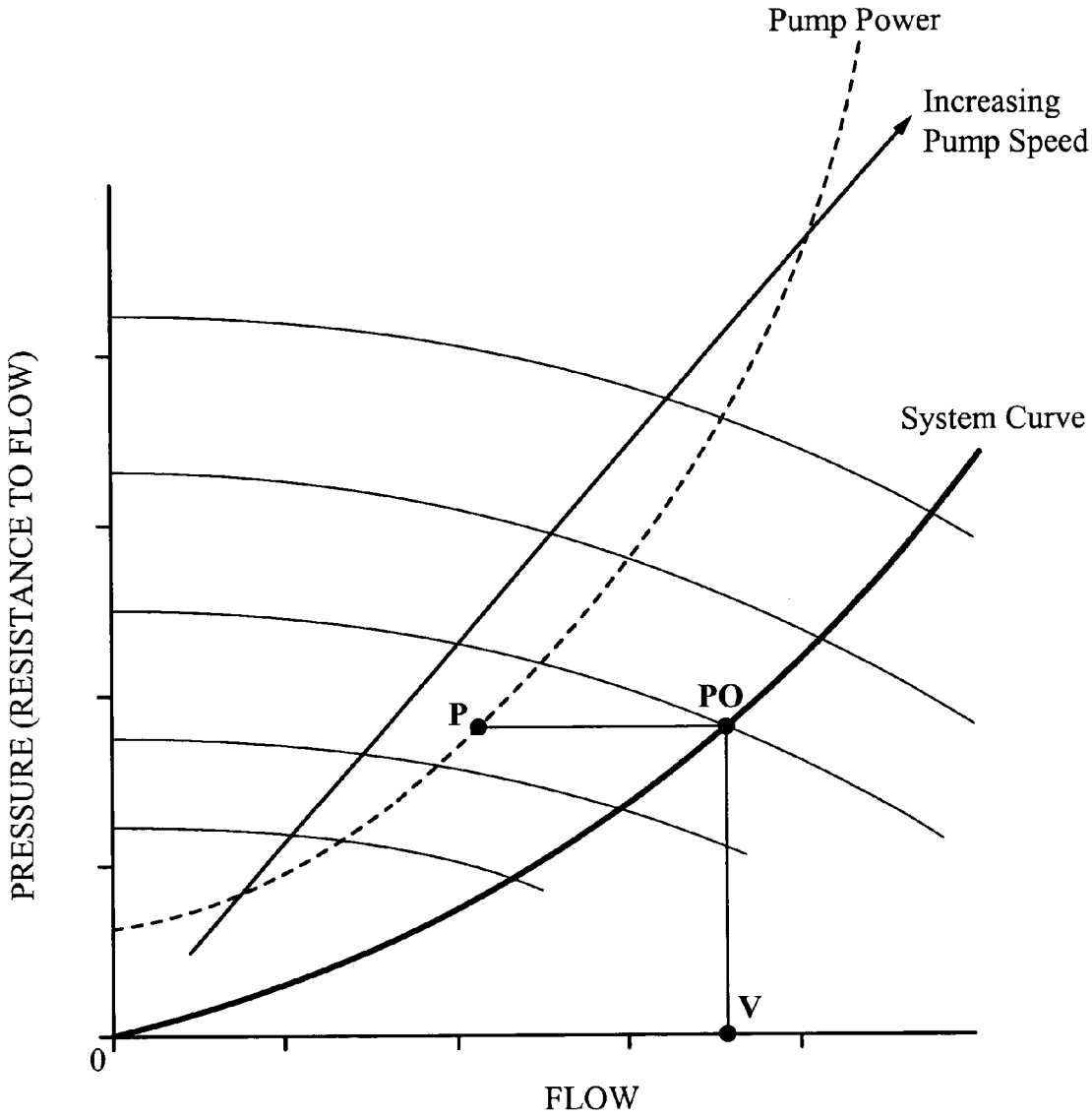
FIG. 2 is a representative illustration of a capacity versus pressure variation graph, showing a system curve, in accordance with embodiments of the present invention.

Referring now to the drawings, and more particularly to FIG. 2, there is shown a representative illustration of a capacity versus pressure variation graph, including the curves that correspond to pump performance at various impeller diameters. FIG. 2 also shows a system curve, in accordance with embodiments of the present invention. In accordance with the invention, a system curve, such as depicted in FIG. 2, shows the change in flow with respect to head of the system. The system curve can be based on various factors such as physical layout of the system, process conditions, and fluid characteristics. The point "PO" on the system curve shown in FIG. 2 defines the point of operation of the system, based on a constant pump speed (rpm) and fixed fluid conditions. For purposes of the invention, "fixed fluid conditions" means fixed temperature and fixed pressure. The point "P" on the pump power curve shown in FIG. 2 defines the power required with respect to the point of operation. The point "V" defines the volumetric flow rate with respect to the point of operation.

Figure 3:
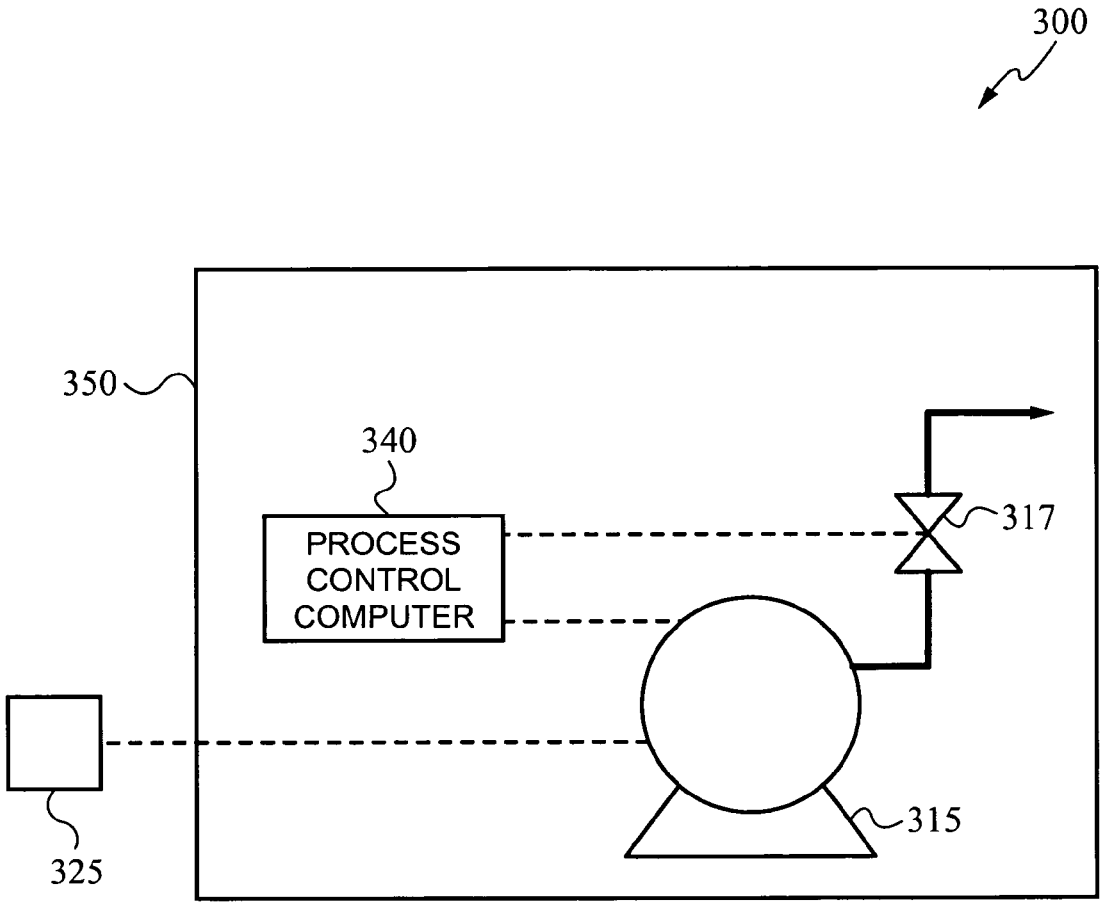
FIG. 3 is a schematic illustration of an apparatus for control of a fluid flow, in accordance with embodiments of the present invention.

FIG. 3 is a schematic illustration of an apparatus 300 for control of a fluid flow, in accordance with embodiments of the present invention. As shown in FIG. 3, in the preferred embodiment of the invention, an apparatus 300 for control of a fluid flow comprises a measuring means 325 for measuring a pump performance parameter and a controller means 350 for adjusting a fluid flow in response to a change in the pump performance parameter. In certain embodiments, the measuring means 325 comprises at least one sensor for measuring pump speed, voltage, electric current, and/or electric power. In certain embodiments, the measuring means comprises a voltage sensor, an electric current sensor, an electric power sensor, and/or a multi-component sensor. Preferably, the controller means 350 comprises a process control computer 340 for adjusting operation of at least one of a flow-control means 317 and a pump 315. In certain embodiments, the flow-control means comprises at least one of a valve, a pneumatic actuator, an electric actuator, a hydraulic actuator, and a micro-electric actuator. In one embodiment, the pump comprises a centrifugal pump. Preferably, the fluid comprises at least one of gaseous, liquid, supercritical and near-supercritical carbon dioxide. It should be understood that solvents, co-solvents and surfactants can be contained in the carbon dioxide.

According to one embodiment of the invention, an apparatus for control of a fluid flow comprises a measuring means for measuring a pump performance parameter; a means for comparing a measured pump performance parameter to a predetermined target pump performance parameter; and a controller means for adjusting a fluid flow in response to a difference in the measured pump performance parameter and the predetermined target pump performance parameter. In one embodiment, the controller means comprises a process control computer for adjusting operation of at least one of a flow-control means and a pump in response to a difference in the measured pump performance parameter and the predetermined target pump performance parameter. It should be appreciated that any means for determining a difference in the measured pump performance parameter and the predetermined target pump performance parameter should be suitable for implementing the present invention, such as a process control computer. In one embodiment, the flow-control means comprises means for adjusting a system element to change the resistance to flow. In certain embodiments of the invention, an apparatus for control of a fluid flow includes means for delivering the fluid flow to means for performing a supercritical process. In certain embodiments, the means for performing a supercritical process comprises a processing chamber and means for circulating at least one of a gaseous, liquid, supercritical and near-supercritical fluid within the processing chamber.

Figure 4:
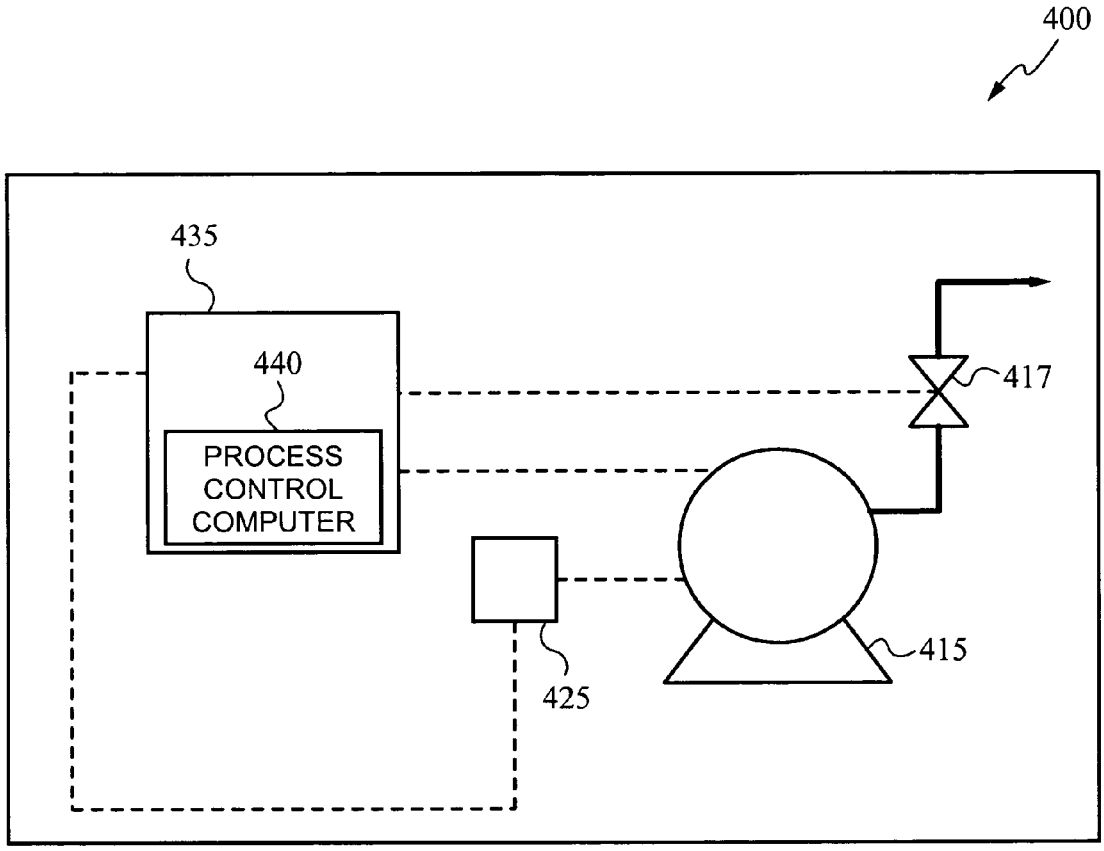
FIG. 4 is a schematic illustration of an apparatus for control of a fluid flow, in accordance with embodiments of the present invention.

FIG. 4 is a schematic illustration of an apparatus 400 for control of a fluid flow, in accordance with embodiments of the present invention. As shown in FIG. 3, in one embodiment of the invention, the apparatus 400 includes a pump 415 for moving a fluid and a sensor 425 for measuring a pump performance parameter. In one embodiment, the pump 415 comprises a centrifugal pump. It should be appreciated that while the invention contemplates the use of a centrifugal pump, various different pumps can be used without departing from the spirit and scope of the invention. Preferably, the fluid comprises at least one of gaseous, liquid, supercritical and near-supercritical carbon dioxide. It should be understood that solvents, co-solvents and surfactants can be contained in the carbon dioxide.

In one embodiment of the invention, the apparatus 400 includes a controller 435 for adjusting operation of the pump to control a fluid flow in response to the pump performance parameter. In one embodiment, the controller 435 includes a process control computer 440. In certain embodiments, the pump performance parameter comprises at least one of a pump speed, voltage, electric current, and electric power.

In one embodiment, a system for supercritical processing of an object comprises: a means for performing a supercritical process; a means for measuring a pump performance parameter; and a means for adjusting operation of a pump to control a fluid flow in response to the pump performance parameter. In certain embodiments, the means for performing a supercritical process includes a processing chamber. The details concerning one example of a processing chamber are disclosed in co-owned and co-pending U.S. patent application Ser. No. 09/912,844, entitled "HIGH PRESSURE PROCESSING CHAMBER FOR SEMICONDUCTOR SUBSTRATE," filed Jul. 24, 2001, Ser. No. 09/970,309, entitled "HIGH PRESSURE PROCESSING CHAMBER FOR MULTIPLE SEMICONDUCTOR SUBSTRATES," filed Oct. 3, 2001, Ser. No. 10/121,791, entitled "HIGH PRESSURE PROCESSING CHAMBER FOR SEMICONDUCTOR SUBSTRATE INCLUDING FLOW ENHANCING FEATURES," filed Apr. 10, 2002, and Ser. No. 10/364,284, entitled "HIGH-PRESSURE PROCESSING CHAMBER FOR A SEMICONDUCTOR WAFER," filed Feb. 10, 2003, the contents of which are incorporated herein by reference.

In certain embodiments of the invention, the means for performing a supercritical process includes a means for circulating at least one of a gaseous, liquid, supercritical and near-supercritical fluid within the processing chamber. Preferably, the fluid comprises carbon dioxide. It should be appreciated that any combination of solvents, co-solvents and surfactants can be contained in the carbon dioxide. In certain embodiments of the invention, the pump performance parameter comprises a pump speed, voltage, current, and power.

Figure 5:
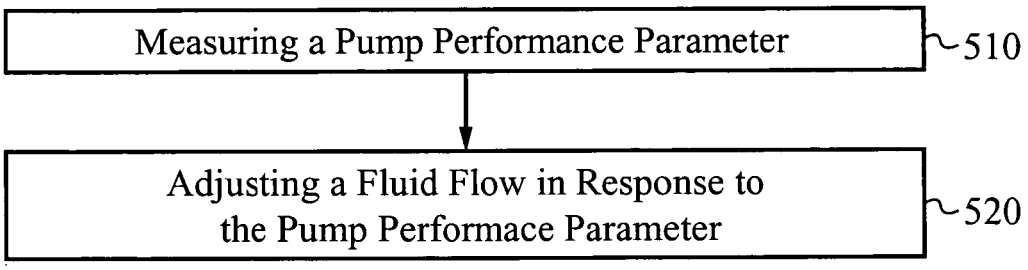
FIG. 5 is a flow chart showing a method of control of a fluid flow, in accordance with embodiments of the present invention.

FIG. 5 is a flow chart showing a method of control of a fluid flow, in accordance with embodiments of the present invention. In step 510, a pump performance parameter is measured. In one embodiment of the invention, the pump performance parameter comprises at least one of a pump speed, voltage, electric current, and electric power. In step 520, a fluid flow is adjusted in response to the performance parameter. Preferably, the fluid comprises at least one of gaseous, liquid, supercritical and near-supercritical carbon dioxide. It should be appreciated that solvents, co-solvents, chemistries, and/or surfactants can be contained in the carbon dioxide.

Figure 6:
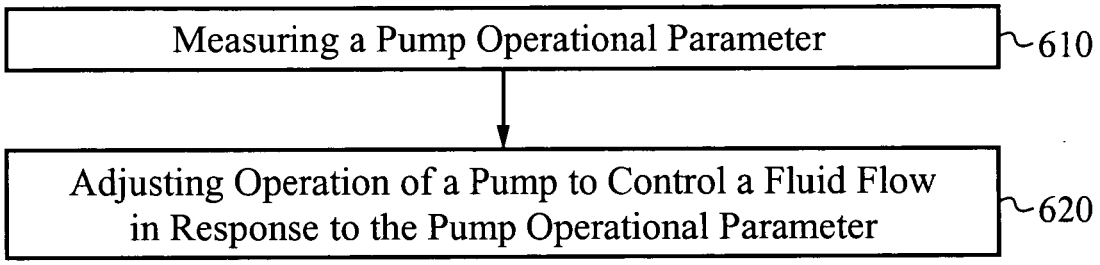
FIG. 6 is a flow chart showing a method of eliminating contamination in semiconductor wafer processing with a fluid, in accordance with embodiments of the present invention.

FIG. 6 is a flow chart showing a method of eliminating contamination in semiconductor wafer processing with a fluid, in accordance with embodiments of the present invention. In step 610, a pump operational parameter is measured. In step 620, operation of a pump is adjusted to control a fluid flow in response to the performance parameter. Preferably, the fluid comprises at least one of gaseous, liquid, supercritical and near-supercritical carbon dioxide. It should be appreciated that solvents, co-solvents, chemistries, and/or surfactants can be contained in the carbon dioxide.

Figure 7:
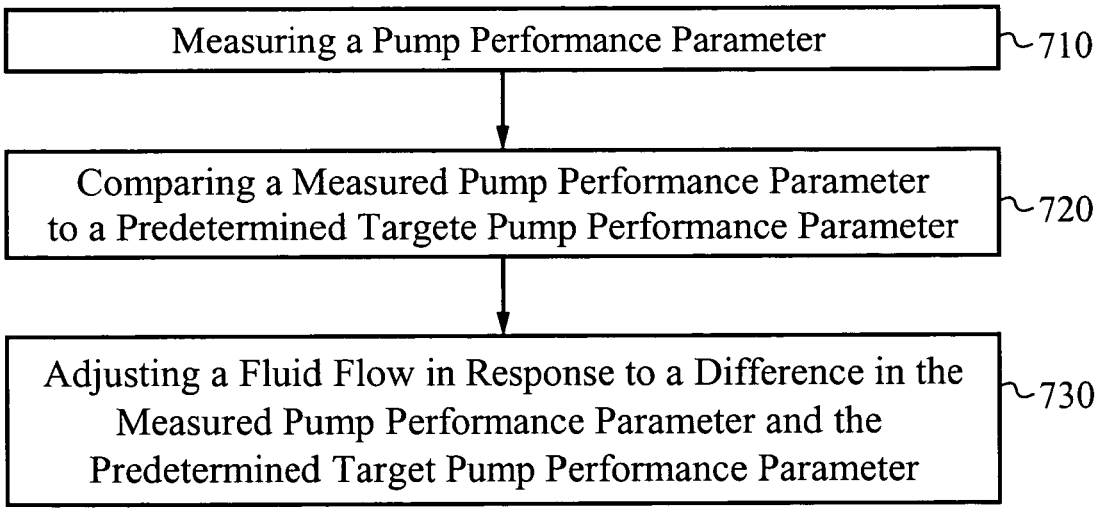
FIG. 7 is a flow chart showing a method of showing a method of control of a fluid flow, in accordance with embodiments of the present invention.

FIG. 7 is a flow chart showing a method of control of a fluid flow, in accordance with embodiments of the present invention. In step 710, a pump performance parameter is measured. In step 720 a measured pump performance parameter is compared to a predetermined target pump performance parameter. In step 730, a fluid flow is adjusted in response to a difference in the measured pump performance parameter and the predetermined target pump performance parameter.

Figure 8:
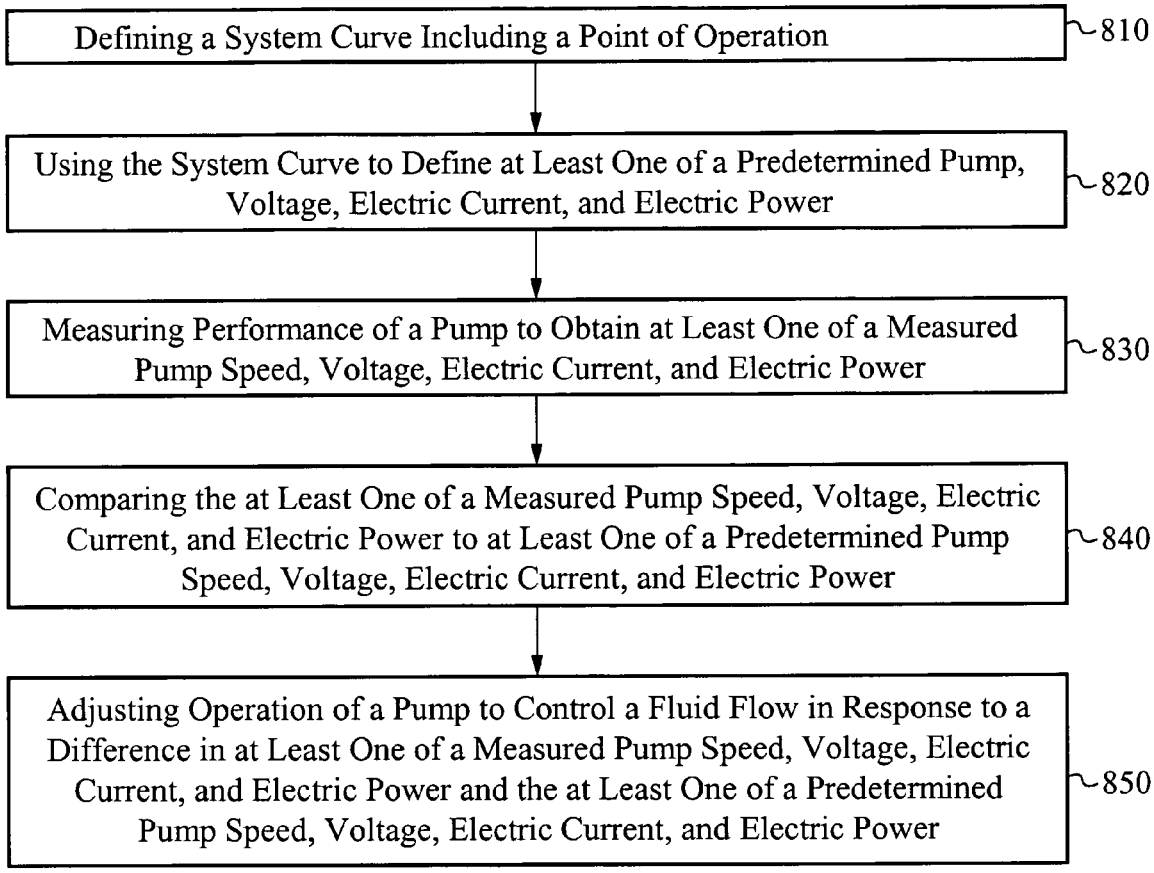
FIG. 8 is a flow chart showing a method of control of a fluid flow in a supercritical processing system, in accordance with embodiments of the present invention.

FIG. 8 is a flow chart showing a method of control of a fluid flow in a supercritical processing system, in accordance with embodiments of the present invention. In step 810, a system curve is defined including a point of operation. In step 820, the system curve is used to define at least one of a predetermined pump speed, voltage, electric current, and electric power. In step 830, performance of a pump is measured to obtain at least one of a measured pump speed, voltage, electric current, and electric power. In step 840, at least one of a measured pump speed, voltage, electric current, and electric power is compared to at least one of a predetermined pump speed, voltage, electric current, and electric power. In step 850, operation of a pump is adjusted to control a fluid flow in response to a difference in at least one of a measured pump speed, voltage, electric current, and electric power and at least one of a predetermined pump speed, voltage, electric current, and electric power.

While the processes and apparatus of this invention have been described in detail for the purpose of illustration, the inventive processes and apparatus are not to be construed as limited thereby. It will be readily apparent to those of reasonable skill in the art that various modifications to the foregoing preferred embodiments can be made without departing from the spirit and scope of the invention as defined by the appended claims.

What is claimed is:

1. A system for supercritical processing of an object, the system comprising:

a. means for performing a supercritical process;

b. means for measuring a pump performance parameter; and c. means for adjusting operation of a pump to control a fluid flow in response to the pump performance parameter, wherein the means for performing a supercritical process comprises a processing chamber and means for circulating at least one of a gaseous, liquid, supercritical and near-supercritical fluid within the processing chamber.

2. The system of claim 1 wherein the object is a semiconductor wafer for forming integrated circuits.

3. The system of claim 1 wherein the means for circulating is a means for circulating a fluid comprising carbon dioxide.

4. The system of claim 3 wherein at least one of solvents, co-solvents and surfactants are contained in the carbon dioxide.

5. The system of claim 1 wherein the pump performance parameter comprises at least one of a pump speed, voltage, electric current, and electric power.

6. The system of claim 1 further comprising means for delivering the fluid flow to the means for performing a supercritical process.

* * * * *